United States Patent [19]

Jarvi

[11] Patent Number: 4,728,365

[45] Date of Patent: Mar. 1, 1988

[54] ROOM TEMPERATURE BLACKENING SOLUTION

[75] Inventor: Paul Jarvi, Orange, Conn.

[73] Assignee: Mitchell Bradford International Corp., Milford, Conn.

[21] Appl. No.: 895,176

[22] Filed: Aug. 11, 1986

[51] Int. Cl.[4] ..... C23C 22/00; C23C 22/48

[52] U.S. Cl. ..... 106/1.05; 106/1.23; 148/6.14 R; 148/6.24

[58] Field of Search ..... 106/1.23, 1.11, 1.05; 148/6.24, 6.14

[56] References Cited

U.S. PATENT DOCUMENTS

| | | | |
|---|---|---|---|
| 2,303,350 | 12/1942 | Fuller | 148/6.24 |
| 2,527,232 | 10/1950 | Scroxton | 148/6.24 |
| 2,836,526 | 5/1958 | Marosi | 148/6.24 |
| 2,846,343 | 8/1958 | Mason | 148/6.24 |
| 2,937,594 | 5/1960 | Miesse | 148/6.24 |

*Primary Examiner*—Theodore Morris

*Attorney, Agent, or Firm*—Ostrolenk, Faber, Gerb & Soffen

[57] ABSTRACT

A room temperature black coating for ferrous metal is formed in a solution based on selenium dioxide, an inorganic copper salt and an organic acid. The solution virtually eliminates the formation of a selenium iron precipitate which results from conventional blackening agents in which an inorganic acid such as phosphoric, sulfuric, nitric or hydrochloric acid is used. Further, the virtual elimination of the precipitate produces the additional benefit that the user needs handle and ultimately dispose of only an insignificant amount of toxic selenium iron or selenium phosphate compound materials.

16 Claims, No Drawings

ROOM TEMPERATURE BLACKENING SOLUTION

BACKGROUND OF THE INVENTION

The present invention is directed to a method for blackening ferrous materials and to an improved blackening solution and in particular to a blackening solution which will cause only negligible precipitation by reaction with the workpiece that is being coated.

Black coatings are formed on a ferrous metal by immersing the ferrous metal object in a blackening solution bath. One type of known blackening solution is designed to be used at room temperature and is primarily an aqueous formulation. A typical room temperature blackening solution formulation contains: selenium dioxide, an inorganic copper salt such as copper sulfate or copper nitrate, and an inorganic acid such as phosphoric, sulfuric, nitric or hydrochloric acid.

An inherent drawback in the known selenium-copper room temperature blackening solutions is that a precipitate forms in the working solution as the bath or solution is used. Some of the iron in the workpiece dissolves in the solution. The dissolved iron reacts with the selenium ions present in the bath to form an iron-selenium or iron-selenium phosphate complex. This causes the bath to become self-consuming. With time, and as more work is passed through the bath, more iron is dissolved and more selenium is precipitated in an unproductive manner. Eventually, the chemical balance of the bath changes to such a degree that individual control of several bath parameters such as dissolved metal concentration (selenium and copper) and acid concentration (phosphoric, nitrate, sulfuric or hydrochloric) is needed. This is both time-consuming and expensive.

In addition, the selenium-iron or selenium phosphate precipitate is a toxic substance. This means that special handling and disposal procedures must be observed.

Accordingly, it is an object of the present invention to provide a room temperature blackening solution which does not suffer from the above described drawbacks.

It is also an object of the present invention to provide a room temperature blackening solution for ferrous metals that produces only negligible by-product precipitation of the active ingredient selenium.

The foregoing and other objects of the present invention are realized in a method for forming a black coating on ferrous metals and by a solution therefor according to which the blackening solution in which the ferrous metal is to be immersed contains selenium dioxide, inorganic copper salt, and an organic acid which causes only negligible precipitation during use.

According to the invention, the almost complete elimination of selenium iron precipitation is obtained in a room temperature formulation in which the active ingredients are consumed only in a productive manner, namely for blackening the ferrous workpiece. Consequently, the formulation according to the invention and as described below approaches 100% efficiency and eliminates the need to monitor individual bath parameters while the bath is in use. What is obtained thereby is a room temperature blackening solution that is user friendly, more easily applied and one which provides a more consistent finish.

Moreover, the almost complete elimination of the by-product precipitation yields the additional benefit that the user need only handle and ultimately dispose of a negligible amount of toxic materials which invariably are formed in consequence of the precipitation which is associated with conventional blackening solutions.

The non-precipitating characteristic of the formulation of the present invention contains the same ingredients as the known formulations except that the inorganic acid is replaced with any organic acid which does not allow formation of the precipitate in the presence of dissolved iron. The solution typically contains selenium dioxide, inorganic copper salt, organic acid, and water. Sulfamic scid is the preferred organic acid.

Thus, a typical room temperature blackening solution concentrate according to the invention can contain.

| | |
|---|---|
| Selenium dioxide anhydrous | 25–35 gram/liter |
| Copper sulfate pentadydrate | 10–20 gram/liter |
| Ammonium nitrate anhydrous | 5–15 gram/liter |
| Sulfamic acid anhydrous | 20–30 gram/liter |
| Polyoxyethylene ether alcohol (Renex 30 TM) | 1 gram/liter |
| Water | |

In a preferred embodiment, the above ingredients were used in the following proportions:

| | |
|---|---|
| Selenium dioxide anhydrous | 32 gram/liter |
| Copper sulfate pentadydrate | 15 gram/liter |
| Ammonium nitrate anhydrous | 10 gram/liter |
| Sulfamic acid anhydrous | 25 gram/liter |
| Polyoxyethylene ether alcohol (Renex 30 TM) | 1 gram/liter |
| Water | |

The above room temperature blackening solution concentrate is normally used, diluted with water, to the extent of 5% to 20% by volume.

The blackening solution of this invention is used in the same manner as the known room temperature blackening bath.

Although the present invention has been described in relation to a specific embodiment thereof, many other variations and modifications and other uses will now become apparent to those skilled in the art. It is preferred, therefore, that the present invention be limited not by the specific disclosure herein, but only by the appended claims.

What is claimed is:

1. In a room temperature blackening solution comprising a selenium dioxide, inorganic copper salt, acid, and water, the improvement which comprises employing an organic acid as said acid.

2. The room temperature solution of claim 1 wherein said acid is sulfamic acid.

3. In a room temperature blackening solution comprising a selenium dioxide, inorganic copper salt, acid, and water, the improvement wherein said solution contains:

| | |
|---|---|
| selenium dioxide anhydrous | 25–35 gram/liter |
| copper sulfate pentadydrate | 10–20 gram/liter |
| ammonium nitrate anhydrous | 5–15 gram/liter |
| sulfamic acid anhydrous | 10–30 gram/liter |
| polyoxyethylene ether alcohol | 1 gram/liter. |

4. The room temperature solution of claim 3 wherein said solution comprises:

| | |
|---|---|
| selenium dioxide anhydrous | about 32 gram/liter |
| copper sulfate pentadydrate | about 15 gram/liter |
| ammonium nitrate anhydrous | about 10 gram/liter |
| sulfamic acid anhydrous | about 25 gram/liter |
| polyoxyethylene ether alcohol | about 1 gram/liter. |

5. In a method for forming a black coating on a ferrous metal substrate comprising contacting the substrate with a blackening solution comprised of selenium dioxides, inorganic copper salt, acid, and water, the improvement which comprises employing an organic acid as said acid; and immersing said ferrous metal in said solution.

6. In a method for forming a black coating on a ferrous metal substrate comprising coating the substrate with a blackening solution comprised of selenium dioxides, inorganic copper salt, acid, and water the improvement which comprises employing a sulfamic acid as said acid; and immersing said ferrous metal in said solution.

7. The method of claim 6 wherein said solution comprises:

| | |
|---|---|
| selenium dioxide anhydrous | 25–35 gram/liter |
| copper sulfate pentadydrate | 10–20 gram/liter |
| ammonium nitrate anhydrous | 5–15 gram/liter |
| sulfamic acid anhydrous | 10–30 gram/liter |
| polyoxyethylene ether alcohol | 1 gram/liter. |

8. The method of claim 7 wherein said solution comprises:

| | |
|---|---|
| selenium dioxide anhydrous | about 32 gram/liter |
| copper sulfate pentadydrate | about 15 gram/liter |
| ammonium nitrate anhydrous | about 10 gram/liter |
| sulfamic acid anhydrous | about 25 gram/liter |
| polyoxyethylene ether alcohol | about 1 gram/liter. |

-continued

9. The solution of claim 1 in which the blackening solution is a concentrate which is diluted with water and has a concentration in the range of 5% to 20% by volume.

10. The solution of claim 2 in which the blackening solution is a concentrate which is diluted with water and has a concentration in the range of 5% to 20% by volume.

11. The solution of claim 3 in which the blackening solution is a concentrate which is diluted with water and has a concentration in the range of 5% to 20% by volume.

12. The solution of claim 4 in which the blackening solution is a concentrate which is diluted with water and has a concentration in the range of 5% to 20% by volume.

13. In a method for forming a black coating on a ferrous metal substrate comprising coating the substrate with a blackening solution comprised of selenium dioxides, inorganic copper salt, acid, and water, the improvement which comprises employing an organic acid as said acid; immersing said ferrous metal in said solution; said blackening solution being a concentrate which is diluted with water and has a concentration in the range of 5% to 20% by volume.

14. The method of claim 6 in which the blackening solution is a concentrate which is diluted with water and has a concentration in the range of 5% to 20% by volume.

15. The method of claim 7 in which the blackening solution is a concentrate which is diluted with water and has a concentration in the range of 5% to 20% by volume.

16. The method of claim 8 in which the blackening solution is a concentrate which is diluted with water and has a concentration in the range of 5% to 20% by volume.

* * * * *